US009186774B2

(12) United States Patent
Swedek et al.

(10) Patent No.: US 9,186,774 B2
(45) Date of Patent: Nov. 17, 2015

(54) X-RAY METROLOGY FOR CONTROL OF POLISHING

(71) Applicant: Applied Materials, Inc., Santa Clara, CA (US)

(72) Inventors: Boguslaw A. Swedek, Cupertino, CA (US); Dominic J. Benvegnu, La Honda, CA (US); Wen-Chiang Tu, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 112 days.

(21) Appl. No.: 13/830,032

(22) Filed: Mar. 14, 2013

(65) Prior Publication Data

US 2014/0273745 A1 Sep. 18, 2014

(51) Int. Cl.
*B24B 49/12* (2006.01)
*B24B 37/013* (2012.01)

(52) U.S. Cl.
CPC ..... *B24B 49/12* (2013.01); *B24B 37/013* (2013.01)

(58) Field of Classification Search
CPC ..... B24B 49/10
USPC ..... 451/5, 6, 37, 57, 1
See application file for complete search history.

(56) References Cited

U.S. PATENT DOCUMENTS 5,738,574 A 4/1998 Tolles et al.
6,062,949 A * 5/2000 Yashiki et al. ..... 451/10
6,213,844 B1 * 4/2001 Lenkersdorfer ..... 451/6
6,466,642 B1 10/2002 Meloni
6,629,879 B1 * 10/2003 Kim et al. ..... 451/57
7,195,535 B1 * 3/2007 Swedek et al. ..... 451/5
2012/0026492 A1 2/2012 Zhang et al.

OTHER PUBLICATIONS

U.S. Appl. No. 13/791,617, filed Mar. 8, 2013, David et al.
'Geochemical Instrumentation and Analysis,' [online]. "X-Ray Fluorescence (XRF)," 2012, [retrieved on Jun. 18, 2013]. Retrieved from the Internet: http://serc.carleton.edu/research_education/geochemsheets/techniques/NRF.html, 5 pages.
'LearnXRF.com' [online] "Principles of XRF," [retrieved on Jun. 18, 2013]. Retrieved from the Internet: URL: http://www.learxrf.com/Principles_of_XRF.htm, 1 page.

(Continued)

*Primary Examiner* — Robert Rose
(74) *Attorney, Agent, or Firm* — Fish & Richardson P.C.

(57) ABSTRACT

A method of controlling a polishing operation includes receiving a first measurement of a first amount of metal on a substrate made by a first x-ray monitoring system after a first metal layer is deposited on the substrate and before a second metal layer is deposited on the substrate, transferring the substrate to a carrier head of a chemical mechanical polishing apparatus the substrate after the second metal layer is deposited on the substrate, making a second measurement of a second amount of metal on the substrate with a second x-ray monitoring system in the chemical mechanical polishing apparatus, comparing the first measurement to the second measurement to determine a difference, and adjusting a polishing endpoint or a polishing parameter of the polishing apparatus based on the difference.

20 Claims, 5 Drawing Sheets

(56) References Cited

OTHER PUBLICATIONS

Qualitest: Advanced Spectroscopy Testing Technologies, [online]. "Portable XRF Analyzer EDX Pocket Genius Series—IV for Metals, Alloys, RoHS, Plastics, Electronics," 2013, [retrieved on Jun. 18, 2013]. Retrieved from the Internet: URL: http://www.worldoftest.com/edxpocket.htm, 3 pages.

EDAX, Coating Thickness and Composition Analysis by Micro-EDXRF, retrieved on Mar. 7, 2013, 8 pages.

Evans Analytical Group, "AN 192: Characterization Methods for Copper Technology," May 4, 2007, Version 3.0, 4 pages.

Fischerscope X-Ray XUL, Coating Thickness Measurement Using X-Ray fluorescence: Fischerscope X-Ray XUL New instrument incorporates proven measurement method, retrieved on Mar. 7, 2013, 4 pages.

Fischerscope, X-Ray, "The Measure of Experience: X-Ray Fluorescence Measuring Instruments for Coating Thickness Measurement and Materials Analysis," retrieved on Mar. 7, 2013, 10 pages.

Kaiser and Wright, "Draft Bruker XRF Spectroscopy User Guide: Spectral Interpretation and Sources of Interference," Nov. 2008, 53 pages.

* cited by examiner

X-RAY METROLOGY FOR CONTROL OF POLISHING

TECHNICAL FIELD

The present disclosure relates to monitoring for control of chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

One problem in CMP is determining whether the polishing process is complete, i.e., whether a substrate layer has been planarized to a desired flatness or thickness, or when a desired amount of material has been removed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, it may not be possible to determine the polishing endpoint merely as a function of polishing time.

In some systems, a substrate is optically monitored in-situ during polishing, e.g., through a window in the polishing pad, using visible, infrared or ultraviolet light. However, existing optical monitoring techniques may not satisfy increasing demands of semiconductor device manufacturers.

SUMMARY

In one aspect, a method of controlling a polishing operation includes receiving a first measurement of a first amount of metal on a substrate made by a first x-ray monitoring system after a first metal layer is deposited on the substrate and before a second metal layer is deposited on the substrate, transferring the substrate to a carrier head of a chemical mechanical polishing apparatus the substrate after the second metal layer is deposited on the substrate, making a second measurement of a second amount of metal on the substrate with a second x-ray monitoring system in the chemical mechanical polishing apparatus, comparing the first measurement to the second measurement to determine a difference, and adjusting a polishing endpoint or a polishing parameter of the polishing apparatus based on the difference.

In another aspect, a polishing apparatus includes a first polishing station, a second polishing station, a transfer station, a carrier head configured to receive a substrate and transport the substrate in sequence to the first polishing statin, the second polishing station and the transfer station, an x-ray monitoring system, and a controller. The x-ray monitoring system has a probe located in the second polishing station, between the first polishing station and the second position station, or between the second polishing station and the transfer station. The controller is configured to receive a first measurement of a first amount of metal on a substrate made after a first metal layer is deposited on the substrate and before a second metal layer is deposited on the substrate, receive a second measurement of a second amount of metal on the substrate from the x-ray monitoring system after the second metal layer is deposited on the substrate; compare the first measurement to the second measurement to determine a difference, and adjust a polishing endpoint or a polishing parameter of the polishing apparatus based on the difference.

Implementations of either aspect may include one or more of the following features. The second metal layer of the substrate may be polished in a first polishing operation until a surface of the underlying material is exposed and metal features remain in recesses in the underlying material. The metal features and the underlying material may be polished in a second polishing operation. Polishing until the surface of the underlying material is exposed may be performed at a first polishing station of the chemical mechanical polishing apparatus, and polishing the metal features and the underlying material may be performed at a second polishing station of the chemical mechanical polishing apparatus. Making the second measurement may include monitoring the substrate during polishing of the metal features and the underlying material with a probe of the second x-ray monitoring system that is located in the second polishing station. Making the second measurement may include monitoring the substrate with a probe of the second x-ray monitoring system that is located between the first polishing station and the second polishing station. Making the second measurement may include monitoring the substrate with a probe of the second x-ray monitoring system that is located between the second polishing station and a transfer station. Exposure of the underlying material may be detected with an IN-situ optical monitoring system in the first polishing station. Making the second measurement may include monitoring the substrate with the second x-ray monitoring system after the first polishing operation and before the second polishing operation. A polishing parameter of the second polishing operation may be adjusted based on the difference. Making the second measurement may include monitoring the substrate with the second x-ray monitoring system after the second polishing operation. Whether to rework the substrate may be determined based on the difference. A plurality of first measurements of the first amount of metal at a plurality of different locations on the substrate made by the first x-ray monitoring system after the first metal layer is deposited on the substrate and before the second metal layer is deposited on the substrate may be received. A location of the second measurement may be determined and which of the plurality of first measurements is at a corresponding location from the plurality of different locations may be determined.

Certain implementations can include one or more of the following advantages. The amount of metal on the substrate, e.g., the thickness of metal lines on the substrate, can be determined. This value can be used to control polishing so that within-wafer and/or wafer-to-wafer non-uniformity (WIWNU and WTWNU) of line resistance may be reduced.

BRIEF DESCRIPTION OF THE DRAWINGS

Like reference numbers and designations in the various drawings indicate like elements.

DETAILED DESCRIPTION

In many semiconductor manufacturing techniques, metal lines are disposed in a dielectric layer. For example, recesses can be etched in the dielectric layer, metal can be deposited to fill the recesses and cover the dielectric layer, and the metal can then be polished back to expose the upper surface of the dielectric layer, leaving metal filling the recesses to provide the metal lines.

One potential problem is that the depth of recesses may not be well controlled, leading to variation in depth of the metal lines across a substrate or from substrate-to-substrate. In addition, optical monitoring techniques in the visible, infrared and ultraviolet regime may not provide accurate measurement of the depth of the metal lines. Without being limited to any particular theory, the extinction coefficient of the metal may be sufficiently high that the reflectance will not depend on the metal thickness, and the depth of the recesses may not be well correlated to the depth of the dielectric layer.

One monitoring technique for controlling a polishing operation is to employ an x-ray technique, e.g. x-ray fluorescence or (XRF) or x-ray absorption (XRA), in order to determine the amount of metal, e.g., copper, on the substrate. In particular, a value indicative of the depth of metal lines, e.g., copper lines, on the substrate can be determined. This information is used to provide either in-situ or run-to-run control of a polishing process, e.g., control of polishing time and/or polishing pressure. With respect to features on the substrate, the term "thickness" or "depth" is used to refer to the dimension perpendicular to the substrate surface, whereas the term "width" is used to refer to a dimension parallel to the substrate surface.

Figure 1:
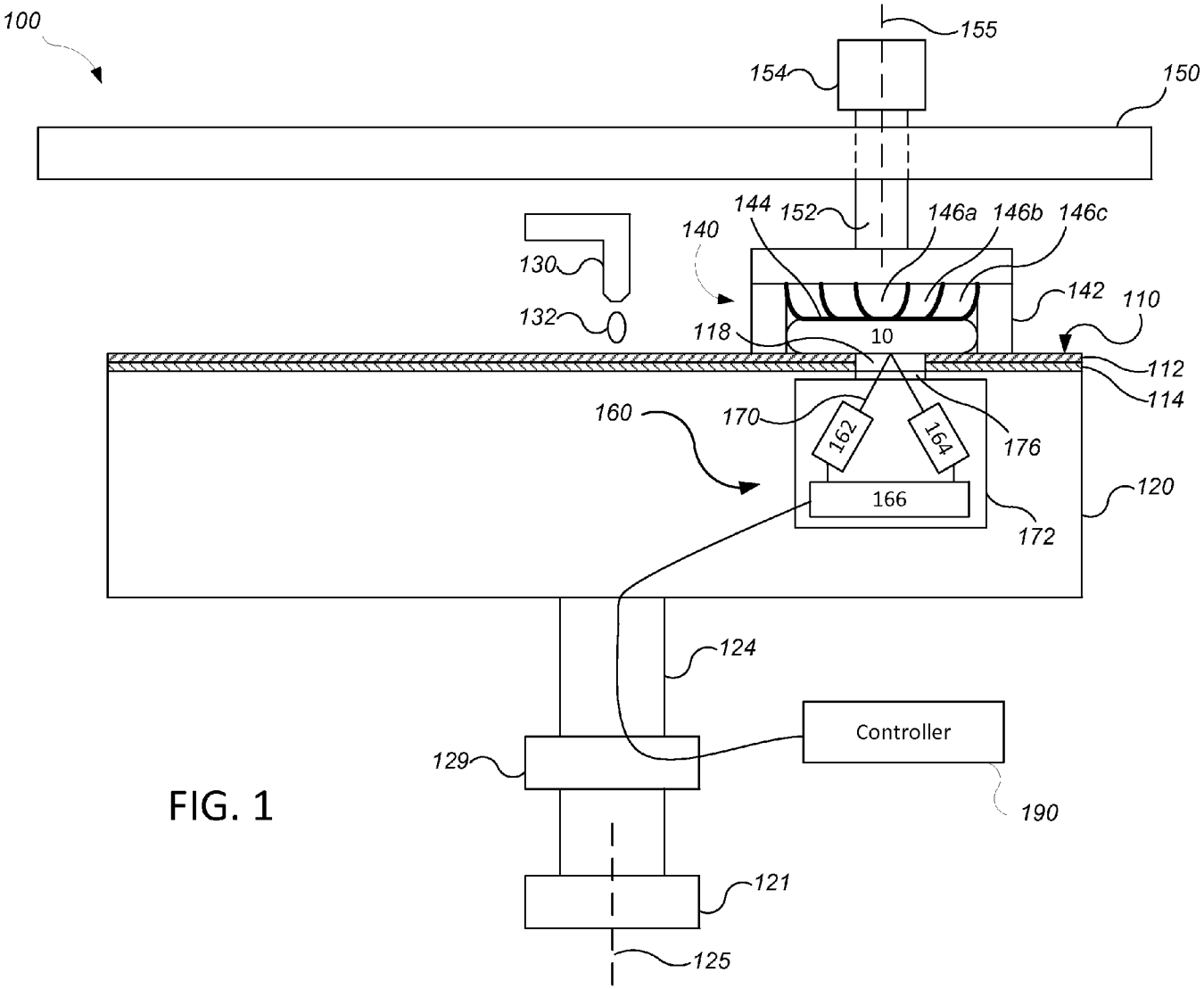
FIG. 1 illustrates a schematic cross-sectional view of an example of a polishing apparatus.

FIG. 1 illustrates an example of a polishing station of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate.

In particular, each carrier head 140 can include a retaining ring 142 to retain the substrate 10 below a flexible membrane 144. Each carrier head 140 also includes a plurality of independently controllable pressurizable chambers defined by the membrane, e.g., three chambers 146*a*-146*c*, which can apply independently controllable pressurizes to associated zones on the flexible membrane 144 and thus on the substrate 10. Although only three chambers are illustrated in FIGS. 1-2 for ease of illustration, there could be one or two chambers, or four or more chambers, e.g., five chambers.

Each carrier head 140 is suspended from a support structure 150, e.g., a carousel or track, and is connected by a drive shaft 152 to a carrier head rotation motor 154 so that the carrier head can rotate about an axis 155. Optionally each carrier head 140 can oscillate laterally, e.g., on sliders on the carousel 150; by rotational oscillation of the carousel itself, or by motion of a carriage 108 (see FIG. 2) that supports the carrier head 140 along the track. In operation, the platen is rotated about its central axis 125, and each carrier head is rotated about its central axis 155 and translated laterally across the top surface of the polishing pad.

In some implementations, the polishing apparatus includes an in-situ x-ray monitoring system 160, which can be used to monitor progress of polishing of a substrate. For example, as shown in FIG. 1, a probe of the x-ray monitoring system 160 can be installed and rotate with in the platen 120. Alternatively, a probe of the x-ray monitoring system can be below the platen, and can be fixed in position below the carrier head; measurements can be taken each time an aperture in the platen rotates into position between the carrier head and the probe.

Figure 2:
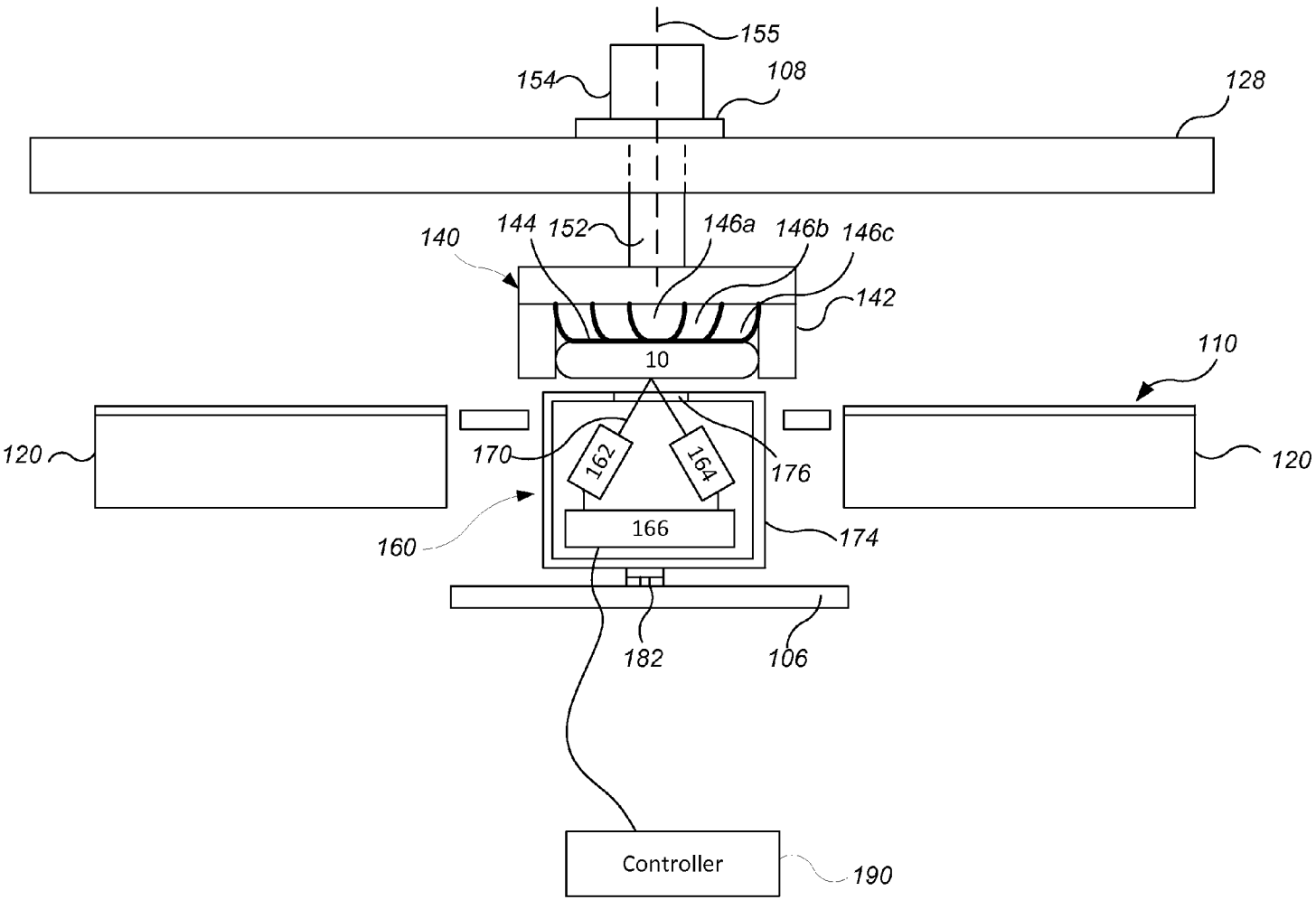
FIG. 2 illustrates a schematic cross-sectional view of an example of an in-sequence x-ray metrology station.

In some implementation, illustrated in FIG. 2, the polishing apparatus includes an in-sequence x-ray monitoring system 160. The probe of the in-sequence x-ray monitoring system 160 can be positioned between two polishing stations, between a polishing station and a transfer station, or within a transfer station. The probe of the in-sequence monitoring system 160 can be supported on a platform 106, and can be positioned on the path of the carrier head.

Referring to FIGS. 1 and 2, in either of the in-situ or in-sequence implementations, the x-ray monitoring system 160 can include an x-ray source 162, an x-ray detector 164, and circuitry 166 for sending and receiving signals between a controller 190, e.g., a computer, and the x-ray source 162 and x-ray detector 164.

The x-ray source 162 can generate an x-ray beam 170 that impinges the surface of the substrate 10 in a measurement spot. The x-ray source 162 can be a conventional x-ray emitter tube, e.g., an anode of Rhodium (Rh), Gold (Au) or Tantalum (Ta). The x-ray source 162 can generate x-rays at a wavelength between 0.008 and 8 nm (energy between 0.12 and 120 keV. The x-ray beam 170 can impinge the surface of the substrate 10 at an angle relative to normal, e.g., between 1° and 85°.

In some implementations, the x-ray beam 170 causes x-ray fluorescence (XRF) of the material of the substrate, which can be detected by the x-ray detector 164. In general, for a correctly selected wavelength, the intensity of the fluorescence increases with the amount of material, e.g., metal. X-ray fluorescence measurements RF can be conducted in an energy-dispersive mode or in a wavelength-dispersive mode. In the energy-dispersive mode, the X-rays emitted by the fluorescing material are directed onto a solid state detector without using a grating to disperse the radiation (as is done in a wavelength-dispersive mode). The energy dispersive mode measures photon energies. The wavelength dispersive mode measures the energy of a well-defined, narrow wavelength range.

In some implementations, the x-rays are reflected by the material of the substrate, and the absorption of the x-rays at a particular wavelength is detected.

In some implementations the x-ray detector 164 is an x-ray spectrometer. A spectrometer is an optical instrument for measuring intensity of light over a portion of the electromagnetic spectrum. Typical output for an x-ray spectrometer is the intensity of the light as a function of energy (or wavelength or frequency).

The x-ray source 162 and x-ray detector 164 can be positioned in a recess 172 in the platen or be enclosed in a housing 174. A window 176 formed of a material, e.g., glass, that is substantially transparent to x-rays can be used to seal the recess 172 or housing 174 to prevent slurry or other contaminates from damaging the components of the monitoring system 160. In operation, the x-ray beam 170 is directed through the window 176, and x-rays reflected or fluoresced by the substrate 10 travel back through the window 176 to the detector 164. The x-ray source 162, x-ray detector 164 and window 176 constitute the probe for the monitoring system 160.

Where the x-ray monitoring system 160 is used as an in-situ monitoring system, an aperture 118 can be formed in the polishing pad 110. The aperture is aligned with window 176. However, in some implementations, e.g., depending on the power of the x-ray source 162 and the absorptivity of the polishing pad 110, the x-ray beam 170 can travel directly through the pad 110 and no aperture 118 is needed.

If the x-ray source 162 is installed in the platen 120, due to the rotation of the platen, as the x-ray source 162 travels below a carrier head 140, the monitoring system can make measurements at a sampling frequency such that measurements are taken at locations in an arc that traverses the substrate 10.

If the monitoring system 160 is an in-sequence monitoring system, the housing 174 can be supported on an actuator system 182 that is configured to move the x-ray source 162 laterally in a plane parallel to the surface of the substrate. The actuator system 182 can be an XY actuator system that includes two independent linear actuators to move probe 180 independently along two orthogonal axes. In some implementations, there is no actuator system 182, and the x-ray source 162 remains stationary (relative to the platform 106) while the carrier head 126 moves to cause the spot measured by the monitoring system 160 to traverse a path on the substrate. For example, the carrier head 140 can rotate while it translates laterally (due to motion of the carriage 108 along the track 108 or due to rotation of the carousel), thereby causing the spot monitored by the monitoring system 160 to traverse a spiral path across the substrate 10.

In some implementations, the monitoring system 160 includes a mechanism to adjust a vertical height of the x-ray source 162 and/or detector 164 relative to the top surface of the platform 106 or the relative to the carrier head 140.

As noted above, the x-ray source 162 and x-ray detector 164 can be connected to a computing device, e.g., the controller 190, operable to control their operation and receive their signals. The computing device can include a microprocessor situated near the polishing apparatus, e.g., a programmable computer. In operation, the controller 190 can receive, for example, a signal that carries information describing an intensity of the x-rays, e.g., a spectrum of the x-rays, received by the detector 164.

In general, the wavelength of x-ray fluorescence is material specific. In addition, the intensity of the x-ray fluorescence at the particular wavelength is generally proportional to the amount of the material present. By selecting the wavelength at which the metal, e.g., copper, fluoresces, the amount of metal in the measurement spot on the substrate can be determined.

In general, the wavelength of x-ray absorption is also material specific. In addition, the absorption of the x-rays at the particular wavelength is generally proportional to the amount of the material present. By selecting the wavelength at which the metal, e.g., copper, absorbs, the amount of metal in the measurement spot on the substrate can be determined.

If there were no other metal layers present on the substrate, the total amount of metal in the area being monitored (i.e., in the measurement spot) would be proportional to the thickness of the metal lines in the measurement spot. However, there are typically other metal layers disposed on the substrate below the layer to be polished. One issue is that the other metal layers contribute to the intensity of the x-ray fluorescence and/or absorption, leaving the metal line thickness uncertain.

Figure 3A:
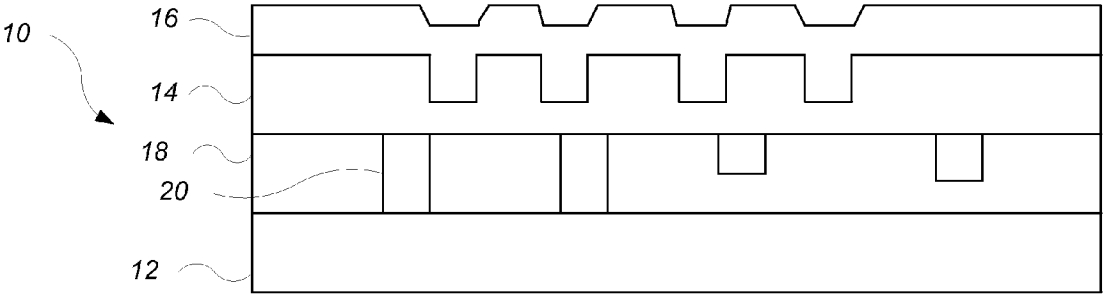
FIGS. 3A-3C illustrate a schematic cross-sectional view of a substrate at different times in a polishing process.
Figure 3B:
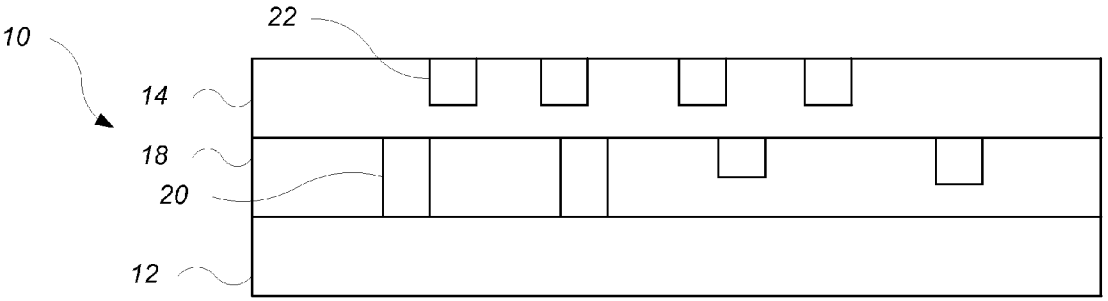
Figure 3C:
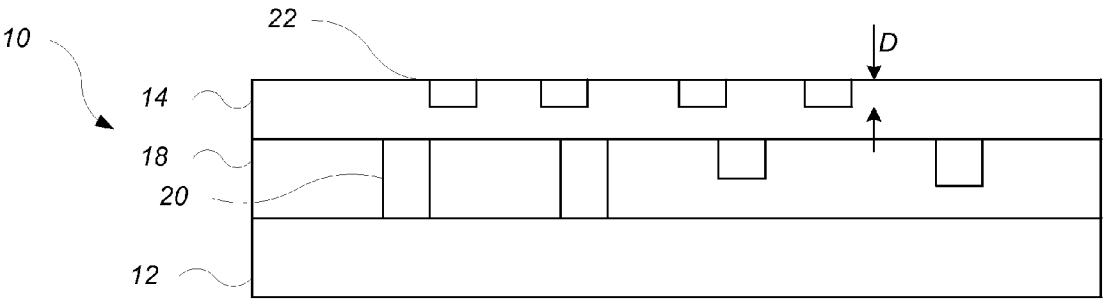

For example, referring to FIG. 3C, a typical substrate 10 can include a semiconductor wafer 12 and an outermost dielectric layer 14 in which metal features 16, e.g., lines, are formed. A layer stack 18 including one or more additional layers is between the outermost dielectric layer 14 and the semiconductor wafer 12. The layer stack 18 can include metal regions 20. As noted above, a typical goal for a polishing operation is to polish both the outermost dielectric layer 14 and the metal features 16 so that the metal features 16 have a uniform thickness D both within the substrate and substrate-to-substrate.

One approach is to measure the amount of metal present on the substrate prior to formation of the metal features 16. For example, intensity of x-ray fluorescence can be measured at multiple spots on the substrate 10 prior to formation of the metal features 16. For example, the substrate 10 can be measured after formation and planarization of the layer stack 16, but before deposition of the dielectric layer 14. The signal intensity of a measurement after formation of the metal feature 16 can be subtracted from the signal intensity of a measurement before formation of the metal features 16. The remaining signal should be indicative of the amount of metal in the metal features 16, and thus indicative of the thickness of the metal features 16.

Figure 4:
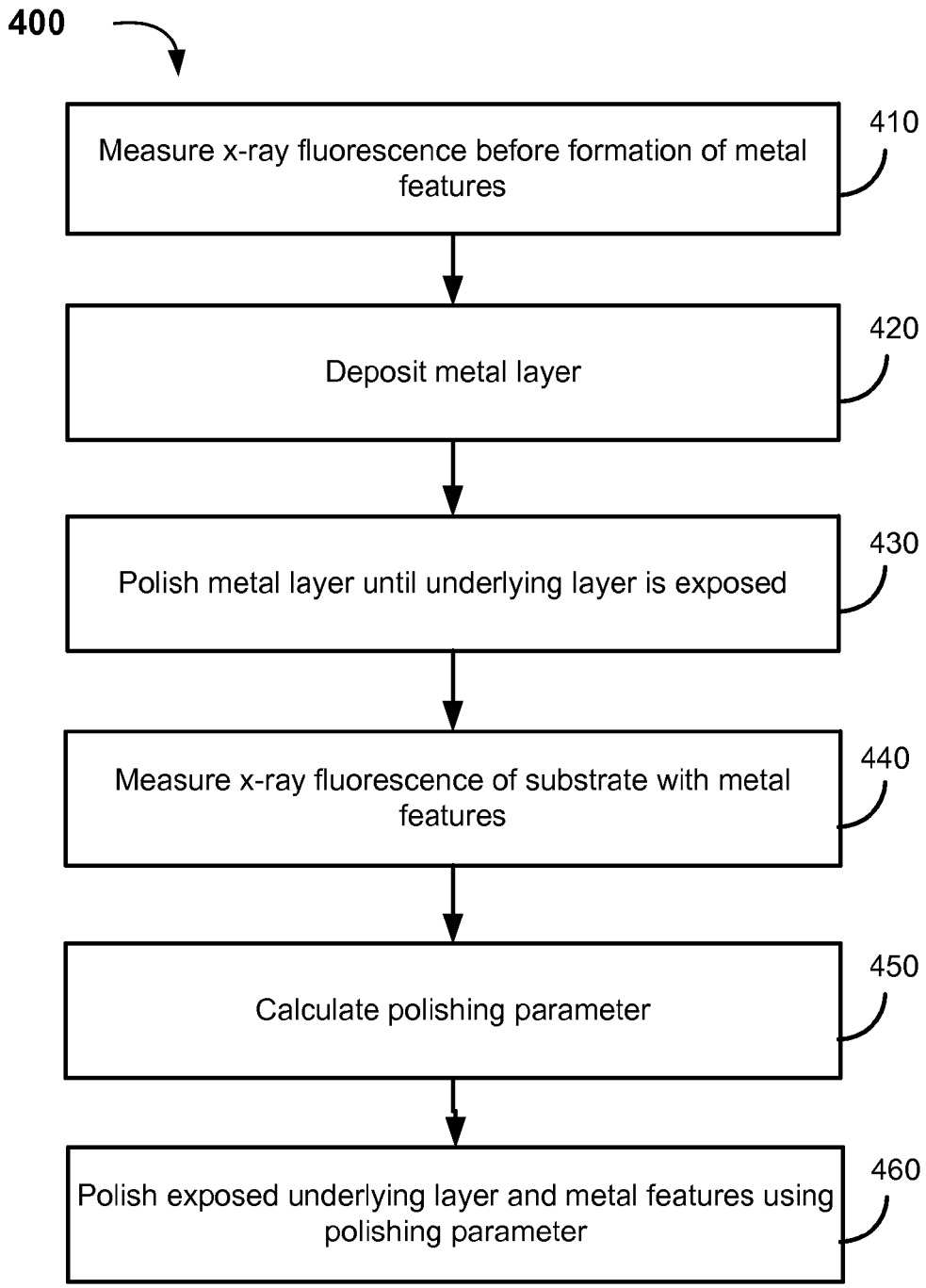
FIG. 4 is a flow graph of a method for controlling a polishing operation.

FIG. 4 shows a flow graph of a method 400 for controlling a polishing operation of a product substrate. Initially, before the metal features are formed, an x-ray monitoring system—a first x-ray monitoring system—is used to make at least one measurement of x-ray intensity at the wavelength corresponding to the material of the metal features (step 410). Measurements can be made at a first of locations on the substrate. The measurements can be made after the underlying layer stack is deposited and planarized, but before the metal layer is deposited on the substrate. The measurements can be made before or after the outermost dielectric layer is deposited, and before or after recesses are etched into the outermost dielectric layer.

Fabrication of the substrate progresses. For example, the outermost dielectric layer is deposited and then etched to form recesses. Eventually, the metal layer is deposited onto the substrate (step 420). As shown in FIG. 3A, the metal layer 16 fills the recesses, but typically also covers the top surface of the dielectric layer 14. Therefore, the metal layer can be polished back until the underlying layer—which can be the dielectric layer or a barrier layer—is exposed (step 430). As shown in FIG. 3B, the top surface of the dielectric layer 14 is substantially cleared (there could be small amounts of metal residue remaining). This leaves the metal in the recesses, thus forming the metal features 22.

In some implementations, bulk polishing of the metal layer to expose the underlying layer is performed at a first polishing station of a polishing apparatus. Exposure of the underlying layer can be detected with an in-situ optical sensor at the first polishing station. Polishing at the first polishing station can be halted upon detection of exposure of the underlying layer.

At some point after the metal features are formed, an x-ray monitoring system—a first x-ray monitoring system—is used to make at least one measurement (step 440). For example, after exposure of the underlying layer is detected, the substrate can be transported to an in-sequence monitoring station, e.g., the x-ray monitoring system 160 of FIG. 2. The in-sequence monitoring station can be positioned between the first polishing station and a second position station. In some implementations, a plurality of measurements are made at a second plurality of locations on the substrate. At least some of the second locations correspond to the first locations. Thus, the second plurality of locations can be or include a subset of the first plurality of locations.

In some implementations, the measurements made with the probe of the first x-ray monitoring system tracing out the same path on the substrate as the probe of the second x-ray monitoring system. In this case, it may be possible to correlate the positions of the second plurality of locations with the first locations simply by timing of the measurements.

In some implementations, the probe of the first x-ray monitoring system makes a larger number of measurements on the substrate than the second x-ray monitoring system. For example, the first x-ray monitoring system can make measurements that are spaced uniformly across the substrate. In this case, the locations of the measurements on the substrate by the second x-ray monitoring system can be determined, e.g., by calculating positions of the measurements based on encoder signals. The controller can determine which measurements are at corresponding locations.

The x-ray monitoring system measures the x-ray intensity at the wavelength corresponding to the material of the metal features. For at least one of the second locations that has a corresponding first locations, the signal intensity from the measurement before the metal feature was formed is subtracted from the signal intensity from the measurement after the metal feature was formed. This leaves a difference value which should scale with the thickness of the metal features in the location. Optionally, the difference value can be converted to a thickness value, e.g., by reference to a look-up-table or a discrete function, e.g., a linear function.

In some implementations, the probe of the first x-ray monitoring system is used to make multiple measurements distributed uniformly across the substrate, and an average value is calculated from those measurements. Then, during IN-situ monitoring with the second x-ray monitoring system, the measurements made during a sweep are averaged together. The averaged value from the measurements from the second x-ray monitoring system can be compared to the average value from the measurements from the first x-ray monitoring system. The difference which should scale with the average thickness of the metal features across the substrate.

A polishing parameter, e.g., a polishing time or pressure, can be calculated (step 450) based on the value output from step 440—either difference value or thickness value—and a target thickness for the metal features.

The substrate is then subjected to a second polishing step using the calculated polishing parameter (step 460). In some implementations, this polishing step is performed at the second polishing station of the polishing apparatus. Because a polishing parameter is based on the thickness of the metal features, within-wafer and/or wafer-to-wafer uniformity of the metal feature thickness, and thus of the line resistance, can be improved.

In some implementations, which can be in alternative or in addition to the method above, the substrate is monitored in-situ, i.e., while the substrate is being polished, using the x-ray monitoring system. In this case, positions on the substrate of measurements by the in-situ monitoring system can calculated, e.g., based on encoder signals from the motors driving the platen and carrier head. The signal intensity from a measurement at the location before the metal feature was formed is subtracted from the signal intensity from the in-situ measurement at the location to generate a difference value which should be proportional to the thickness of the metal features in the location. The polishing operation can thus be controlled using the values measured in-situ.

In some implementations, which can be in alternative or in addition to either of the methods above, the substrate is monitored at an in-sequence x-ray monitoring system after polishing of the metal lines. This method is similar to the first method, in that the signal intensity from the measurement at a location before the metal feature was formed is subtracted from the signal intensity from a measurement at the location after the metal feature has been polished. This leaves a difference value which should be proportional to the thickness of the metal features in the location. If the value indicates that the metal features are too thick, the substrate can be sent back to the polishing station for rework. Alternatively or in addition, the values can be used in a feedback algorithm to adjust a polishing parameter for a subsequent substrate at the polishing station.

In some implementations, a multi-platen polishing system can include an optical monitoring system in one platen and an x-ray monitoring system in another platen or between the platens. An example of a multi-platen polishing system is described in U.S. Pat. No. 5,738,574 and in U.S. application Ser. No. 13/791,617, filed Mar. 8, 2013, each of which is incorporated by reference.

Figure 5:
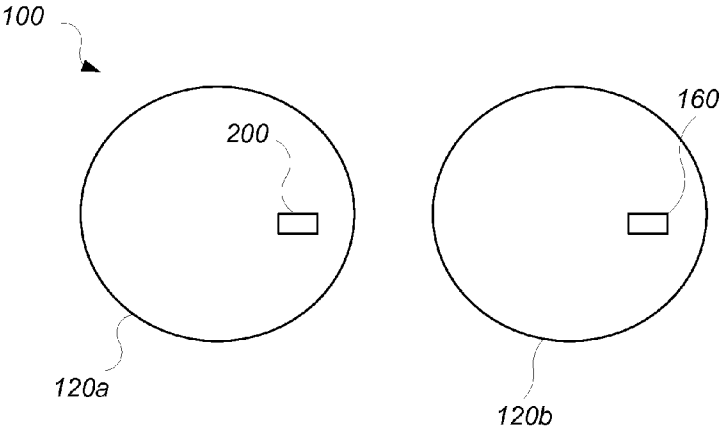
FIG. 5 illustrates a schematic top view of a polishing system with multiple platens.

For example, referring to FIG. 5, in some implementations, the polishing apparatus 100 includes a first polishing station with a first platen 120*a*, and a second polishing station with a second platen 120*b*. The first polishing station includes an in-situ optical monitoring system 200 that uses visible light, e.g., a visible light spectrometry system. An example of an in-situ monitoring system is described in U.S. Patent Publication No. 2012-0026492, which is incorporated by reference. The second polishing station includes the x-ray monitoring system 160, e.g., positioned in the platen 120*b* as described above with reference to FIG. 1.

Figure 6:
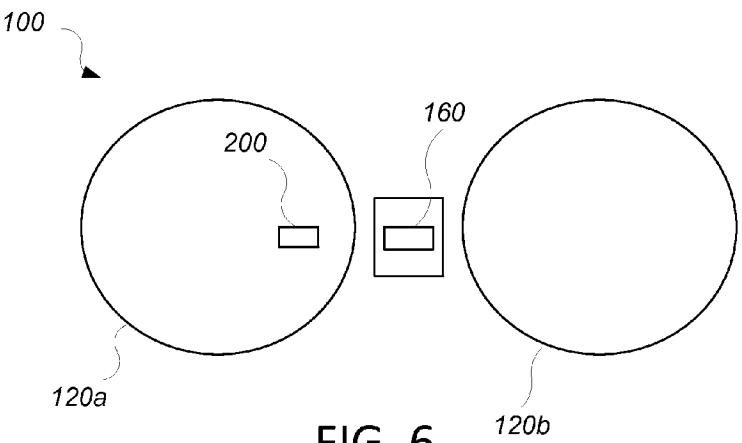
FIG. 6 illustrates a schematic top view of another implementation of a polishing system with multiple platens.

As another example, referring to FIG. 6, in some implementations, the polishing apparatus 100 includes a first polishing station with a first platen 120*a*, and a second polishing station with a second platen 102*b*. The first polishing station includes an in-situ optical monitoring system 200 that uses visible light, e.g., a visible light spectrometry system. An example of an in-situ monitoring system is described in U.S. Patent Publication No. 2012-0026492, which is incorporated by reference. The x-ray monitoring system 160 is positioned between the first polishing station and the second polishing station, e.g., as between the first platen 120*a* and the second platen 120*b* as described above with reference to FIG. 2.

Figure 7:
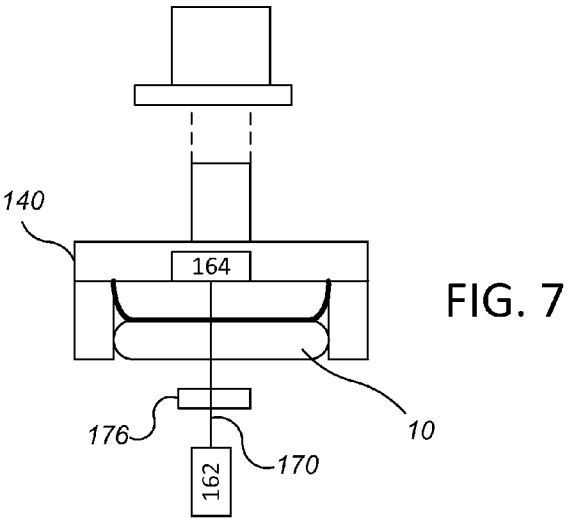
FIG. 7 illustrates a schematic cross-sectional view of a x-ray monitoring system with a detector in a carrier head.
Figure 8:
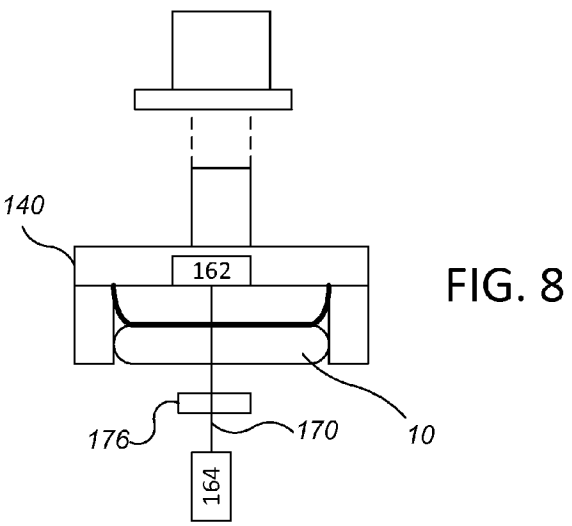
FIG. 8 illustrates a schematic cross-sectional view of a x-ray monitoring system with an x-ray source in a carrier head.

In some implementations, the x-ray monitoring system using x-ray absorption. For example, referring to FIG. 7, an x-ray source 162 can direct an x-ray beam through the substrate 10 that is held by the carrier head 140 to a detector 162 held in the carrier head 140. Alternatively, referring to FIG. 8, an x-ray source 162 held by the carrier head 140 can direct an x-ray beam from the top side of the substrate, through the substrate 10, to a detector 162 held in the platen or in-sequence monitoring station. In either arrangement, absorption of x-rays at a particular wavelength is generally proportional to the amount of the material present.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a machine readable storage media, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling a polishing operation, comprising:

receiving a first measurement of a first amount of metal on a substrate made by a first x-ray monitoring system after a first metal layer is deposited on the substrate and before a second metal layer is deposited on the substrate;

transferring the substrate to a carrier head of a chemical mechanical polishing apparatus after the second metal layer is deposited on the substrate;

polishing the second metal layer;

after polishing at least a portion of the second metal layer, making a second measurement of a second amount of metal on the substrate with a second x-ray monitoring system in the chemical mechanical polishing apparatus;

comparing the first measurement made before the second metal layer is deposited to the second measurement made after the second metal layer is deposited and at least the portion of the second metal layer is polished to determine a difference; and adjusting a polishing endpoint or a polishing parameter of the polishing apparatus based on the difference.

2. The method of claim 1, comprising polishing the second metal layer of the substrate in a first polishing operation until a surface of an underlying material is exposed and metal features remain in recesses in the underlying material.

3. The method of claim 2, comprising polishing the metal features and the underlying material in a second polishing operation.

4. The method of claim 3, wherein polishing until the surface of the underlying material is exposed is performed at a first polishing station of the chemical mechanical polishing apparatus and polishing the metal features and the underlying material is performed at a second polishing station of the chemical mechanical polishing apparatus.

5. The method of claim 4, wherein making the second measurement comprises monitoring the substrate during polishing of the metal features and the underlying material with a probe of the second x-ray monitoring system that is located in the second polishing station.

6. The method of claim 4, wherein making the second measurement comprises monitoring the substrate with a probe of the second x-ray monitoring system that is located between the first polishing station and the second polishing station.

7. The method of claim 4, wherein making the second measurement comprises monitoring the substrate with a probe of the second x-ray monitoring system that is located between the second polishing station and a transfer station.

8. The method of claim 4, comprising detecting exposure of the underlying material with an in-situ optical monitoring system in the first polishing station.

9. The method of claim 3, wherein making the second measurement comprises monitoring the substrate with the second x-ray monitoring system after the first polishing operation and before the second polishing operation.

10. The method of claim 9, comprising adjusting a polishing parameter of the second polishing operation based on the difference.

11. The method of claim 3, wherein making the second measurement comprises monitoring the substrate with the second x-ray monitoring system after the second polishing operation.

12. The method of claim 11, comprising determining whether to rework the substrate based on the difference.

13. The method of claim 1, comprising receiving a plurality of first measurements of the first amount of metal at a plurality of different locations on the substrate made by the first x-ray monitoring system after the first metal layer is deposited on the substrate and before the second metal layer is deposited on the substrate.

14. The method of claim 13, comprising determining a location of the second measurement and determining which of the plurality of first measurements is at a corresponding location from the plurality of different locations.

15. A polishing apparatus, comprising:

a first polishing station;

a second polishing station;

a transfer station;

a carrier head configured to receive a substrate and transport the substrate in sequence to the first polishing station, the second polishing station and the transfer station;

an x-ray monitoring system having a probe located in the second polishing station, between the first polishing station and the second position station, or between the second polishing station and the transfer station; and a controller configured to receive a first measurement of a first amount of metal on the substrate made after a first metal layer is deposited on the substrate and before a second metal layer is deposited on the substrate, receive a second measurement of a second amount of metal on the substrate from the x-ray monitoring system after the second metal layer is deposited on the substrate and after at least a portion of the second metal layer has been polished, compare the first measurement made before the second metal layer is deposited to the second measurement made after the second metal layer is deposited and at least the portion of the second metal layer is polished to determine a difference, and adjust a polishing endpoint or a polishing parameter of the polishing apparatus based on the difference.

16. The apparatus of claim 15, wherein the controller is configured to cause the apparatus to polish the second metal layer of the substrate until a surface of an underlying material is exposed and metal features remain in recesses in the underlying material at the first polishing station.

17. The apparatus of claim 16, wherein the controller is configured to cause the apparatus to polish the underlying material at the second polishing station.

18. The apparatus of claim 15, wherein the probe of the x-ray monitoring system is located in the second polishing station.

19. The apparatus of claim 15, wherein the probe of the x-ray monitoring system is located between the first polishing station and the second polishing station.

20. The apparatus of claim 15, wherein the probe of the x-ray monitoring system is located between the second polishing station and the transfer station.

* * * * *